US007585207B2

(12) United States Patent
Barriger

(10) Patent No.: US 7,585,207 B2
(45) Date of Patent: Sep. 8, 2009

(54) THROWING WHEEL ASSEMBLY

(76) Inventor: Allan Barriger, 2604 Kate, Hole, MI (US) 48842

( * ) Notice: Subject to any disclaimer, the term of this patent is extended or adjusted under 35 U.S.C. 154(b) by 0 days.

(21) Appl. No.: 12/001,060

(22) Filed: Dec. 7, 2007

(65) Prior Publication Data

US 2009/0149117 A1 Jun. 11, 2009

(51) Int. Cl.
*B24C 5/06* (2006.01)

(52) U.S. Cl. ..... 451/97; 451/95; 451/98

(58) Field of Classification Search ..... 451/36, 451/38, 91, 95, 97, 98
See application file for complete search history.

(56) References Cited

U.S. PATENT DOCUMENTS 3,869,289 A 3/1975 Amering
5,476,412 A * 12/1995 Stoltz ..... 451/75
5,584,748 A * 12/1996 Flynn et al. ..... 451/91
5,759,091 A * 6/1998 MacMillan ..... 451/95
6,447,378 B1 * 9/2002 Hoff ..... 451/95
6,981,910 B1 * 1/2006 Goff ..... 451/91
2008/0076333 A1 * 3/2008 Krause et al. ..... 451/94

* cited by examiner

*Primary Examiner*—Eileen P. Morgan
(74) *Attorney, Agent, or Firm*—John R. Benefiel

(57) ABSTRACT

A throwing wheel assembly including a wheel and a series of throwing blades mounted in radial channels in the wheel formed with mating dovetail wing portions on the slot sides and a projecting at the base of the blade. A sloping grove in the bottom of each channel engages a projecting ramp feature on the base of the mating blade received therein to cam the blade outwardly and thereby create a tight fit of the dovetail portions and to lock the blades in position.

8 Claims, 2 Drawing Sheets

THROWING WHEEL ASSEMBLY

BACKGROUND OF THE INVENTION

The throwing blades must be removable since they wear out and must be routinely replaced. The mounting must provide for accurate location on the wheel radially since varying of the radial position can result in a wheel imbalance when rotated at high speed. Excessive clearance can result in tipping of the blade and irregular performance.

The throwing blades must be removable since they wear out and must be routinely replaced. The mounting must provide for accurate location on the wheel radially since varying of the radial position can result in a wheel imbalance when rotated at high speed. Excessive clearance is a result in tipping of the blade and irregular performance.

In addition, any clearance spaces can result in abrasive material entering those spaces and make it difficult or impossible to remove the blade for replacement.

U.S. Pat. No. 5,476,412 describes a method using a tapered dovetail channel to create a tight fit which wedges to locate the blade radially. However, the tapered dovetail is difficult to form accurately by normal casting processes and accuracy of the radial location of the blade may suffer if there are inaccuracies in forming the double tapered dovetail shape. These radial location variations are problematic as described above.

Another approach which is described in U.S. Pat. No. 3,869,289 involves the use of springs to force the blade axially out to bring dovetail wings on the blade into engagement with the dovetail shaped channel sides in the wheel. This requires separate spring elements which can get broken and lost. Proper locking sometimes is not achieved with this design.

It is an object of the present invention to provide a throwing blade mounting to the throwing wheel which does not require precision forming of a double tapered wedge shape in a dovetail but rather uses a simpler shape which is easier to machine and to obtain accurate radial location of the blades on the wheel side plates.

SUMMARY OF THE INVENTION

The above recited object and other objects which will be understood upon a reading of the following specification and claims are achieved by a throwing blade having a parallel dovetailed feature which is configured to engage sides of channels having dovetailed sides. In order to lock the blades in engagement with the dovetailed sides of a mating channels, a slot is formed into the bottom of each channel and a corresponding downwardly projecting cam ramp feature is formed on the base of each blade projecting below the dovetailed feature. The axially sloping bottom surface of the slot and the ramp top surface feature engage with each other to cam the dovetail base on the blade into tight engagement with the dovetailed channel sides to tightly lock the blade to the throwing wheel. With a simple ramp engagement, more accurate radial location of the blades can be achieved while using only conventional casting processes.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
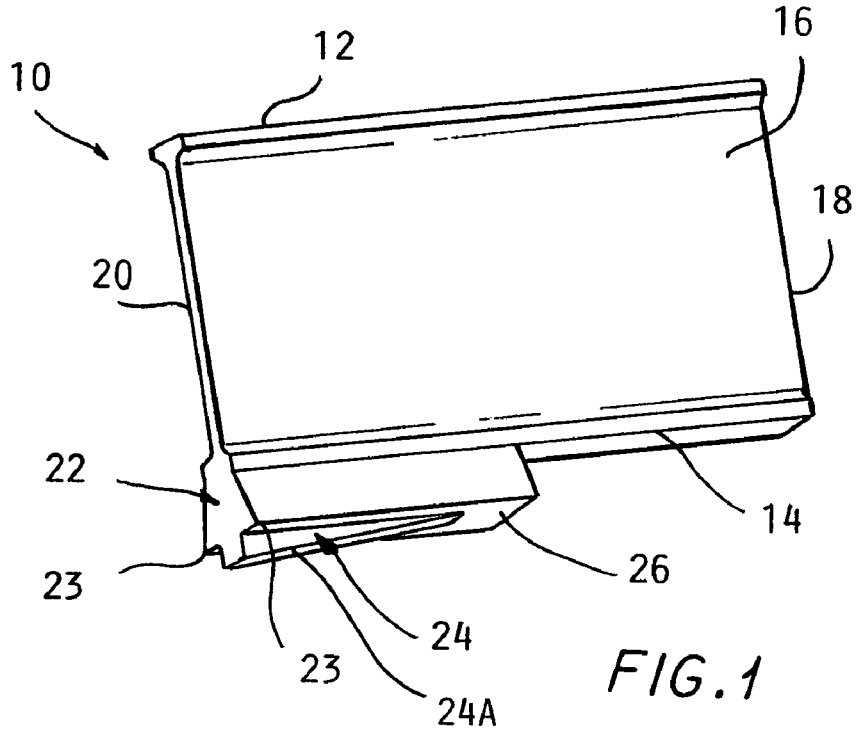
FIG. 1 is a pictorial view of a throwing blade according to the present invention.
Figure 2:
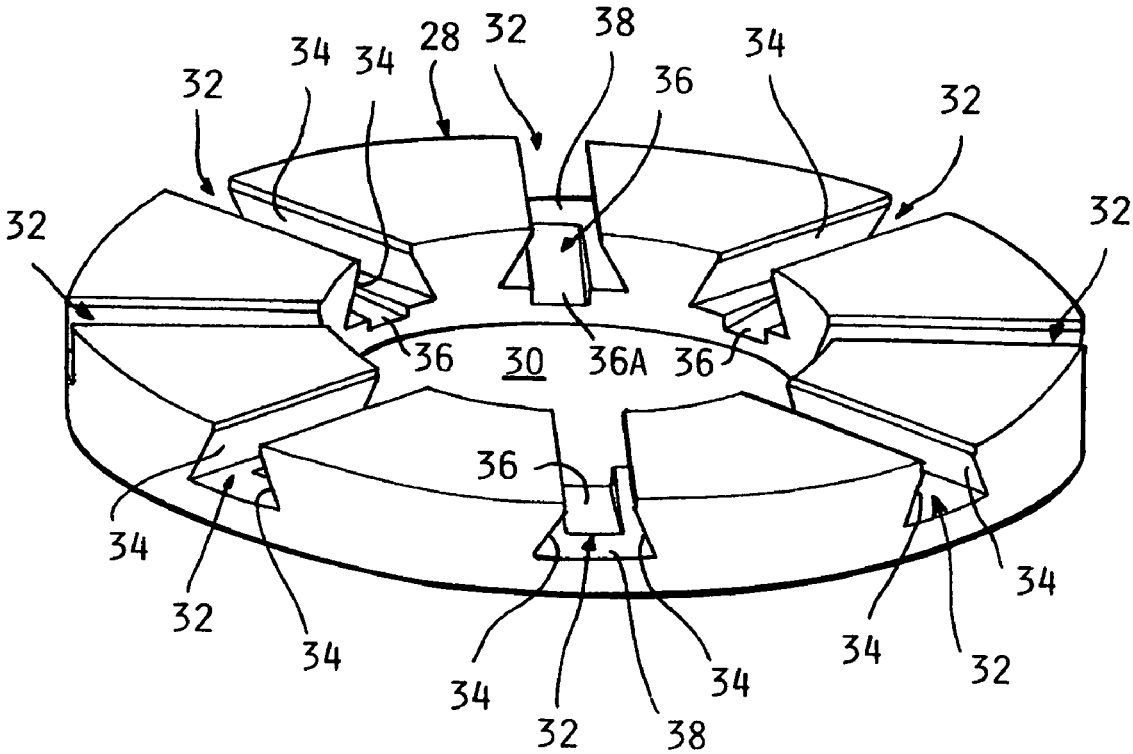
FIG. 2 is a pictorial view of a wheel having radial channels configured to receive blades according to the invention.
Figure 5:
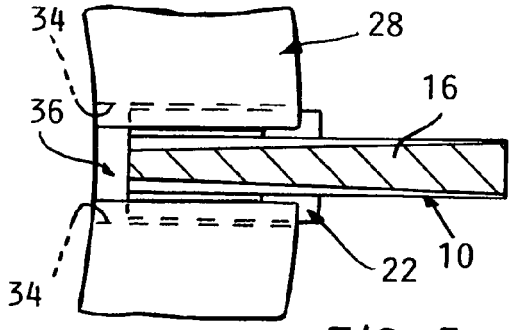
FIG. 5 is a view of a horizontal section through an installed blade, with a fragmentary view of portion of the throwing wheel.

Referring to the drawings and particularly FIGS. 1 and 2, a throwing blade 10 according to the invention is shown adapted to be mounted to a throwing wheel 28 rotated about a central axis in the well known manner. The throwing blade 10 is comprised of a generally rectangular steel casting having an upper and lower edges formed with flanges 12, 14 and a web 16 defining the throwing surfaces. The web 16 is tapered as per conventional practice (as shown in FIG. 5), being thicker at a radially outer end 18 than at a radially inner end 20 of the blade 10.

According to the present invention, a dovetailed feature 22 is formed extending along the base of the blade 10 for approximately one half the length of the blade 10.

The dovetailed feature 22 has sides extending radially and parallel to each other although angled towards each other in the conventional manner.

Projecting in an axially direction from the flat bottom of the dovetailed feature 22 is a camming cam ramp 24 which extends outwardly from the radial inner end 20 of the blade 10, and terminates at a radial outer end at the lower flat surface 26 of the dovetail feature 22. The cam ramp 24 slopes in an axial direction, i.e., the top surface 24A varies in height above the flat surface in the axial direction.

The throwing wheel 28 is annular in shape, having a central hole 30 on the axis of rotation which receives the blades 10 when they are being installed on the wheel 28.

A series of radial channels 32 are formed into one face of the throwing wheel 28.

Each channel 32 includes a pair of dovetailed sides 34 complementary to the dovetail feature 22 on each blade 10 but somewhat larger to allow an easy slidable fit therein.

The bottom of each channel 32 is formed with a bottom sloping surface 36A of a slot 36 matching the top surface 24*a* of the cam ramp 24 extending radial out from the central hole.

Each blade 10 is installed by placing the dovetail feature 22 at the radial inside end of a channel 32 with a flat ramp surface 26 resting on a flat surface 38 defining the bottom of the dovetail channel 32.

Figure 3:
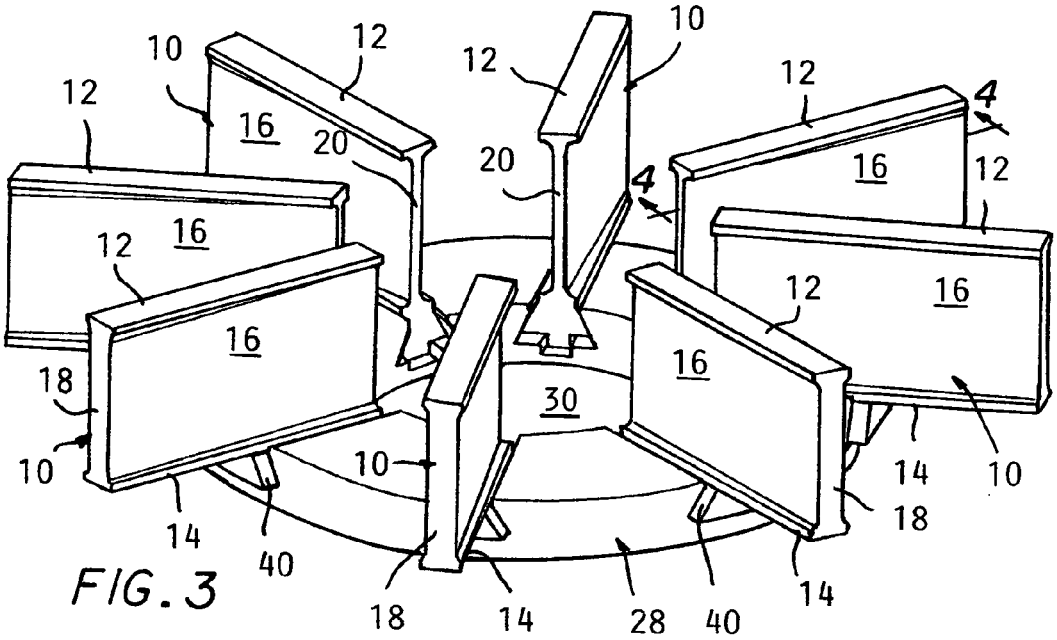
FIG. 3 is a pictorial view of the wheel shown in FIG. 2 with a number of blades shown in FIG. 1 installed therein.
Figure 6:
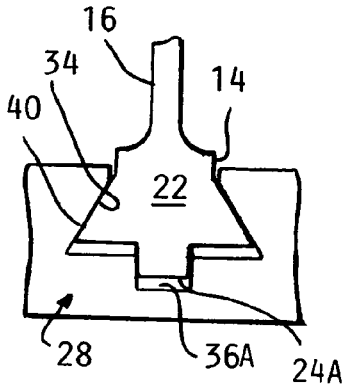
FIG. 6 is an end view of the blade and wheel portions shown in FIG. 4.

The blade 10 is then slid radially out, bringing the sloping bottom of the slot 36 into engagement with the top surface 24*a* of the cam ramp 24. This lifts the blade 10 normally to the channels, (i.e., in an axial direction) by a camming action between the engaged surfaces 36, 24A as the blade 10 is advanced radially in a receiving channel 32 until the sides 40 of the dovetail feature 22 are wedged against the sides of the dovetail channel 32 as seen in FIGS. 3, 4 and 6.

Figure 4:
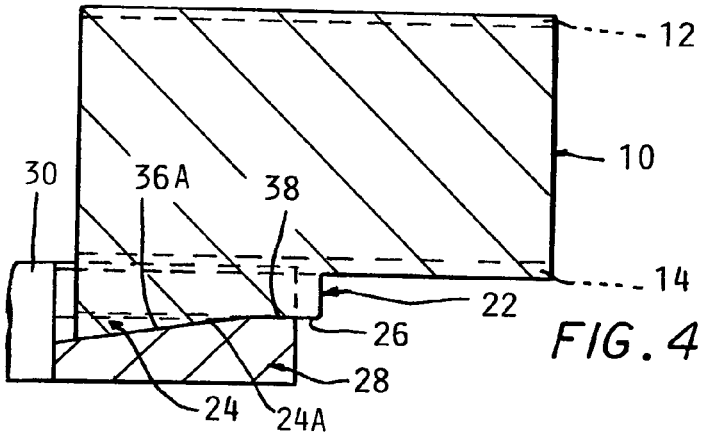
FIG. 4 is an enlarged view of the section 4-4 taken in FIG. 3.

This securely holds the blade 10 in position as seen in FIG. 4 where the cam ramp 24 extends most of the length of the dovetailed 22 which itself extends most of the length of the channel 32. The ramp angle being is sufficiently shallow, i.e., 6°-8° to achieve self-locking of the blades 10 in the channels 32.

This engagement will prevent blade tilting and excessive variations in radial location, yet can be manufactured using ordinary processes.

Removal can be reliably achieved since the clearance between the dovetails are restored by driving the blade 10 to be removed back down the ramp.

The invention claimed is:

1. A throwing wheel and blade assembly comprising:

an annular throwing wheel adapted to be rotated about a central axis and having a central opening and a series of radial channels extending from said opening, each channel having dovetailed sides; an upwardly sloping slot at the bottom of each channel having a bottom surface varying in depth in an axial direction;

a series of throwing blades each received in a respective channel, each blade formed with a dovetail feature extending along a lower base portion and configured to be slidably received in a respective dovetail channel with a clearance therebetween; each blade having a cam ramp projecting axially from said base portion and having a top surface sloping between an inner radial end and an outer radial end of said dovetail feature to be of a higher height at said inner radial end than said outer radial end in an axial direction to be configured complementarily to said bottom surface of said slot in each wheel channel so as to be readily received therein; said blades each radially advanced into a respective wheel channel so that engagement of said ramp feature top surface and sloping slot bottom surface moves said blade axially relative said throwing wheel and thereby brings said dovetail sides of said channel and blade dovetailed feature into tight engagement by inducing movement of said blade in an axial direction as said blades are moved radially out in a respective channel.

2. The throwing wheel assembly according to claim 1 wherein said ramp feature top surface and slot bottom surface extend at a shallow self-locking angle to wedge said blades in position in said respective channels.

3. A throwing blade and wheel assembly according to claim 1 wherein said cam ramp and channel slot extend from said central opening.

4. The throwing blade and wheel assembly according to claim 3 wherein said cam ramp and dovetail feature extend approximately one half of the length of said blade.

5. The throwing blade and wheel assembly according to claim 3 wherein the cam ramp extends most of the length of the dovetailed base.

6. The throwing blade and wheel assembly according to claim 5 wherein each of said dovetailed base of each blade extends most of the length of its associated channel.

7. A method of mounting throwing blades to a throwing wheel a adapted to rotate about a central axis, comprising:

forming a series of radial channels in said throwing wheel having dovetailed channel side extending from a central opening in said wheel;

forming a slot in the bottom of each channel having a bottom surface sloping up in an axial direction from a radial inner end at a maximum depth below said bottom of said channel adjacent said central opening to a radial outer end radially spaced from said inner end and terminating at said bottom of said channel;

forming each blade with a dovetail feature complementary to said dovetailed channel sides along a bottom base matching said dovetail channels but with a clearance therebetween;

forming a cam ramp feature along the bottom of said dovetail feature having a top surface sloping down in an axial direction matching said slot sloping bottom surface;

advancing each blade dovetail feature along said dovetail channel with said cam ramp top surface brought into engagement with said slot a sloping bottom surface to cam said blade out normally in an axial direction and bring said dovetail feature into tight engagement with said dovetailed channel sides.

8. The method according to claim 7 wherein said sloping bottom surface and said ramp top surface are shallowly angled so as to create a self locking wedging action to secure each blade locked in position in an associated channel.

* * * * *